US005222422A

United States Patent [19]

Benner, Jr. et al.

[11] Patent Number: 5,222,422

[45] Date of Patent: Jun. 29, 1993

[54] WIDE RANGE POUCH FORM, FILL, SEAL APPARATUS

[75] Inventors: Harold T. Benner, Jr.; Boris Makutonin, both of Cincinnati, Ohio

[73] Assignee: R.A. Jones & Co. Inc., Covington, Ky.

[21] Appl. No.: 813,192

[22] Filed: Dec. 23, 1991

[51] Int. Cl.[5] ..... B26D 1/62

[52] U.S. Cl. ..... 83/37; 83/152; 83/154; 83/345; 83/411.3

[58] Field of Search ..... 83/24, 37, 100, 152, 83/154, 310, 322, 323, 343, 345, 348, 411.3, 945, 18, 175; 53/562, 568

[56] References Cited

U.S. PATENT DOCUMENTS

| | | | |
|---|---|---|---|
| 3,563,001 | 2/1971 | Cloud et al. | 53/562 |
| 3,597,898 | 8/1971 | Cloud . | |
| 4,404,879 | 9/1983 | Frohwerk et al. | 83/22 |
| 4,872,382 | 10/1989 | Benner et al. | 83/152 |

*Primary Examiner*—Eugenia Jones

*Attorney, Agent, or Firm*—Wood, Herron & Evans

[57] ABSTRACT

A pouch form, fill seal apparatus includes a cutter having a plurality of radially extending knives and package guides which are simultaneously adjustable independently of the knives to accommodate a wider range of pouch chord variations due to pouch size or product fills.

9 Claims, 4 Drawing Sheets

WIDE RANGE POUCH FORM, FILL, SEAL APPARATUS

This invention relates to pouch machines and more particularly to an improved cutter apparatus in a pouch form, fill, seal machine capable of handling a wide range of pouch sizes.

It is known to form a pouch by folding a flat web longitudinally, transversely sealing the doubled web on itself to form a series of open-mouth pouches, passing the double web around a filler wheel and filling the pouches, sealing the open-mouths to form a series of connected sealed pouches, and then passing the sealed train of pouches around a cutter wheel where the transverse seals are sliced to separate individual pouches. This process was carried out continuously, or on the run, without stopping for any operation.

A typical process and an apparatus for performing such process are both disclosed in U.S. Pat. No 3,597,898, which is herewith incorporated herein by reference. Among other disclosures in that patent is a description of the pouch cut-off or cutter apparatus. Such a cutter includes a plurality of radially extending knife blades on a cutter wheel, and another plurality of radially extended blades mounted on a separate rotatable slicer in a fashion to cooperate with the cutter wheel. The knife blades, when the cutter wheel and slicer were turned, came together and sheared individual pouches off the series of sealed pouches in the web.

It should be appreciated that the outer edges of the knife blades extending from the cutter wheel lie in a circle. Each outer knife edge is equi-distant from the other adjacent knife edges, this distance generally , matching the transverse seal-to-seal distance across the pouches. These seals are generally parallel and the distance between the seal centerlines on each side of a pouch is referred to as the "chord". Thus the entire process continues with the knives rotating and cutting off pouches at their transverse seals.

It is not unusual for a product manufacturer to run different types of products on a pouch machine, using pouches of the same pre-fill design size. One type of product might only lightly fill the pouch and another type of product might bulge the pouch considerably.

Such bulging results in a corresponding shortening in the straight line distance between the seals which separate each pouch, and more particularly in the distance between the center-lines of the seals. For pouches of the same pre-fill design sizes, fatter or more bulging filled pouches have a shorter chord than thinner or less bulging filled packages.

The distance between the knife edges must match or be slightly longer than the resulting chord distances between the seals separating the pouches for each specific pouch fill. Since a full pouch will define a shorter seal-to-seal chord than that of a lightly filled pouch, for example, blade edges that match the longer chord of lightly filled pouches would therefore have to be positioned radially inwardly to thus shorten the distance from knife edge to knife edge and match the shorter chord of very full, rounded pouches.

The same parameters are true of situations requiring use of different pre-fill design size pouches on the same machine. In the past, such pouch size changes have required different knife assemblies, or a shut down for a total, independent knife adjustment, for example.

Before the present invention was made, the cutter knives had radially adjustable guides, projecting slightly beyond the edges of the knives. These guides could be individually and independently adjusted for the thinly-packed pouches and contracted for the fully-packed pouches so that without changing the knife position, the varying widths of pouches could be accommodated within a narrow range.

The time required to make the change-over of the independent radially-adjustable guides, normally twelve of them, was about twenty minutes. Following the change, a web would be run to see if the change provided precise cuts centered on the seals. If the adjustment was not entirely satisfactory, a further refinement was made. As indicated, these adjustments could be made only within a narrow range since the actual knife edge was not changed. For a greater range of changes of approximately one-half inch of radial position of the knife edge, shims were provided to also change the mounting of the respective knives. A change where the knives were shimmed would take considerably longer.

To cure that problem, a further advance was made as disclosed in U.S. Pat. No. 4,872,382, which is also incorporated herein by reference. That advance included apparatus for facilitating the adjustment of the radial position of the edges of the knives on rotary cutting apparatus.

This was attained by providing a rotating cage in which the knives are mounted for radial movement only. A cone having a conical surface and disposed in the center of the cage supports the inner edge of each knife. The cone is threaded to a screw passing through the axis of the cage so that upon rotation of the screw the cone moves axially with respect to the cage. When the cone moves axially, the knife blades, mounted on the conical surface, move radially in or out. Thus, with a simple but precise turning of the screw, a very precise and simultaneous change of the radial locations of all knife edges can be made within a minute or so as contrasted to the time-consuming adjustment previously required.

While these advances have proven useful, the range of radial adjustment of the knives does not accommodate as wide a variation in the pouch sizes or fills as is desired. It is thus desired to provide a cutter in a pouch form, fill, seal machine which will accommodate a wider range of pouch sizes or variations in pouch fill.

It has been a further objective of the invention to provide improved cutter apparatus and methods in a pouch form, fill, seal machine accommodating a wider range of pouch sizes and fills while at the same time providing for easy adjustment to minimize downtime between change over for differing pouch or product fills.

To this end, a preferred embodiment of this invention contemplates a cutter apparatus having a plurality of radially disposed knives on a cutter wheel and a plurality of associated, radially disposed package guides which are adjacent respective knives but are separately mounted and are themselves independently and simultaneously adjustable, with respect to said knives, to accommodate varying pouch fills.

In one embodiment, the package guides are mounted via a wheel and cone adjustment mechanism so the package guides can be radially extended or retracted simultaneously and independently of the knives.

When the guides are adjusted according to this invention, separately and independently of the knives, the cutter is able to accommodate a much wider range of pouch chord changes due to product fills than if the knives in such cutter were adjusted throughout the same radial adjustment distance.

Moreover, simultaneous adjustment of the guides, independently of the knives, provides for fast changeover times and minimizes downtime while still accommodating an even wider range of pouch fills than with the prior adjustable knife machines.

It will also be appreciated that the invention described herein may also accommodate different pre-fill pouch design sizes, through simultaneous guide adjustment, without a parts change over or extensive adjustment downtime, in addition to accommodating a wide range of product fills in pouches of the same pre-fill design size.

These and other modifications and advantages will become even more readily apparent from the following detailed description of a preferred embodiment of the invention, and from the drawings in which.

Figure 1:
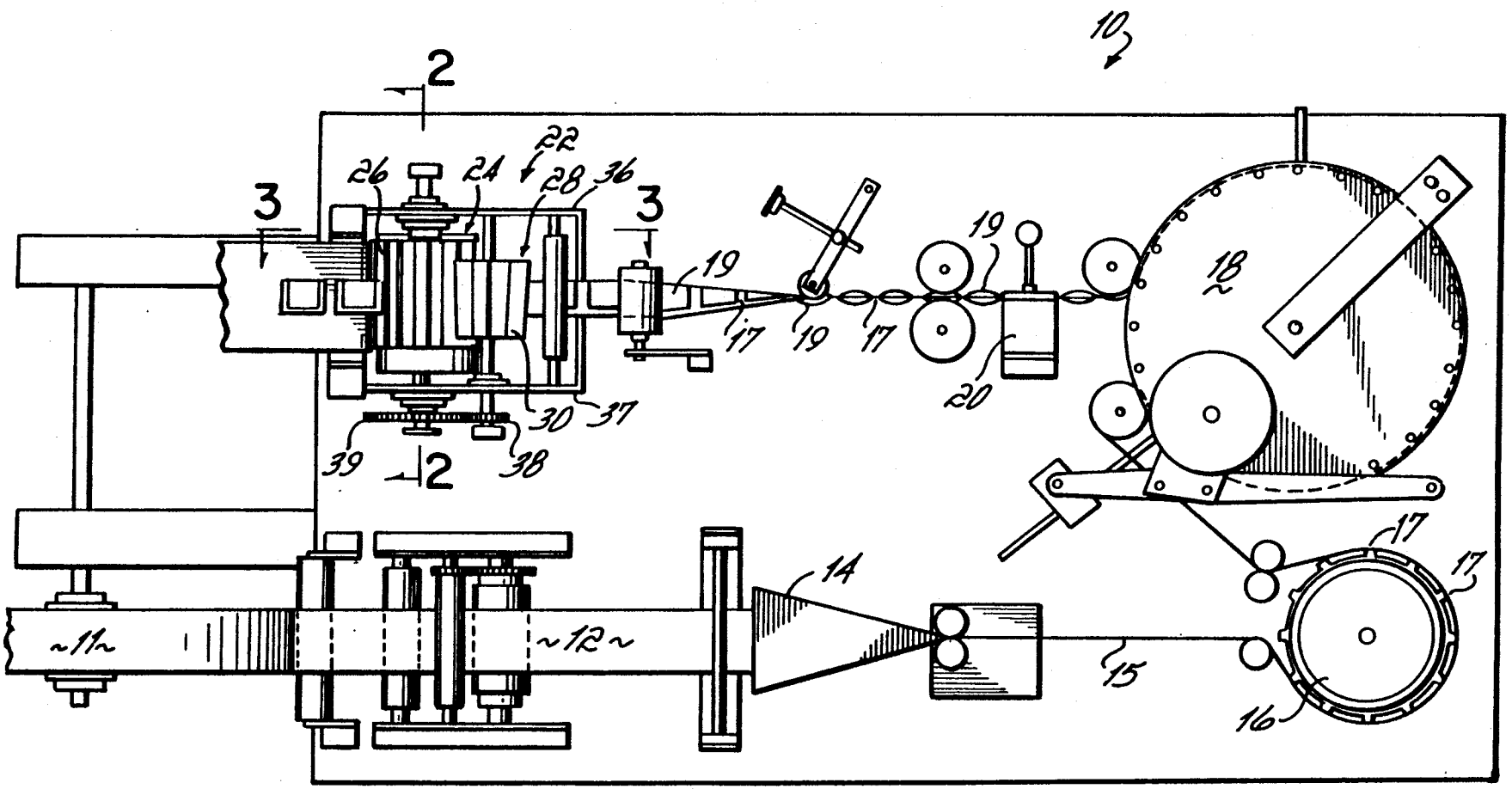
FIG. 1 is a diagrammatic plan view of a pouch form, fill seal machine in which the present invention is used.

Referring to FIG. 1, a pouch form, fill, seal machine 10 has a web supply 11 which feeds a flat web 12 through a plow 14 which folds the web upon itself. The folded web 15 is passed around a sealing wheel 16 which places individual transverse seals 17 on the folded web creating a series of open ended pouches. These pouches are passed to a rotary filling apparatus 18 where they are filled, and the web of filled pouches 19 is then passed to a further upper edge sealing device 20 which seals the open pouch ends, with the filled and sealed pouches in series, one connected to another at a common seal.

After being rotated 90°, the filled, sealed pouches are then passed through a cutting apparatus 22, according to the invention, wherein the web or train of the series of filled pouches 19 is cut into individual pouches along the transverse side seals 17.

The cutting apparatus 22 is the focus of the present invention and includes two interacting rotating knife assemblies: a driving cutter wheel apparatus 24 carrying a plurality of knife blades 26, ten being shown, and a driven slicer apparatus 28 carrying a plurality of knife blades 30, with five being shown. Both sets of blades are attached to the periphery of cages or rotary apparatus rotatably mounted on shafts, and geared to rotate on their respective shafts with the blades interacting and forming a scissors or shearing action across transverse seal 17 of the pouch (see FIG. 3). This particular number of blades is only one form of the apparatus and the number and rotary speed can be varied with different machines and different size pouches.

Figure 2:
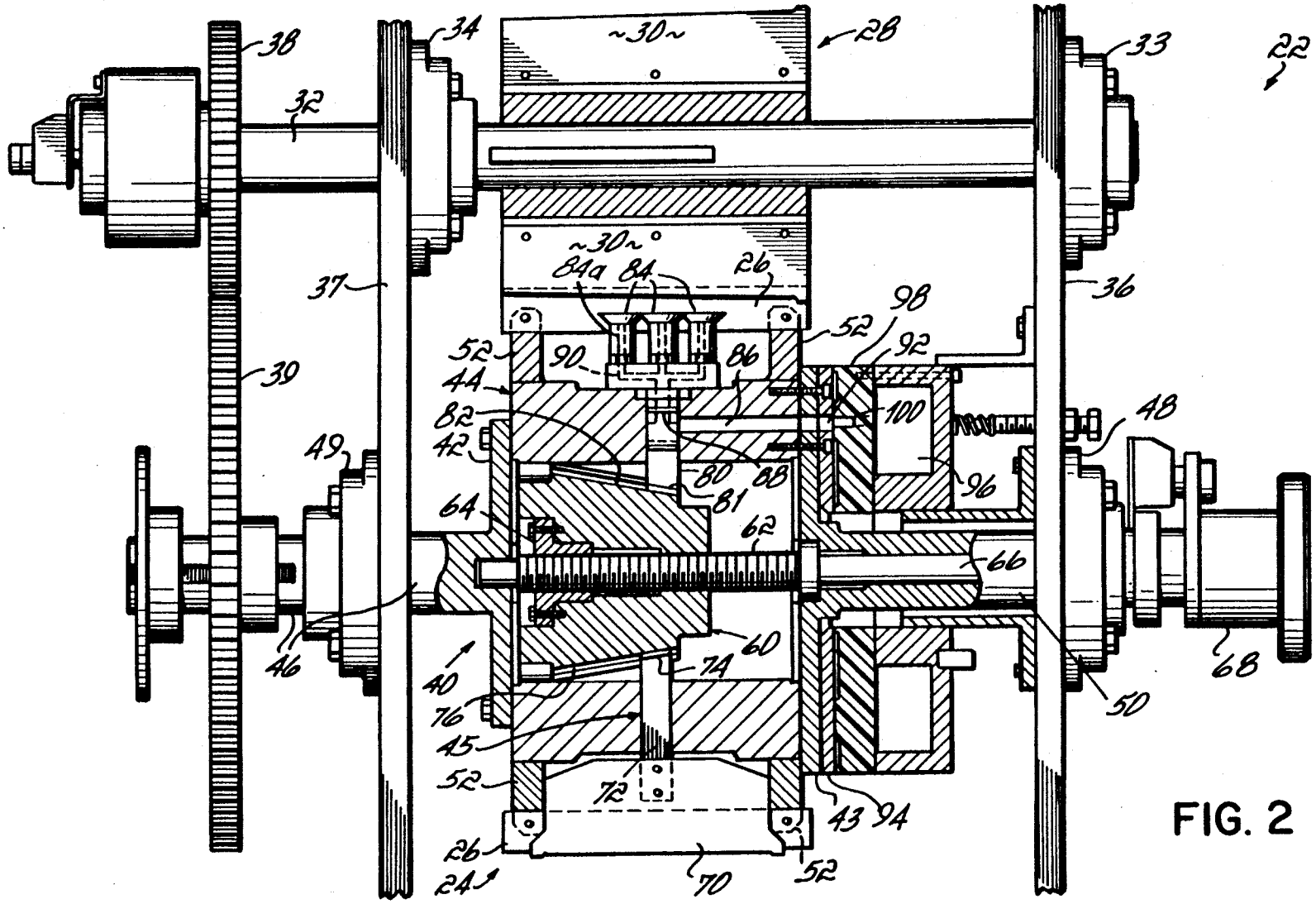
FIG. 2 is a cross-sectional view of the invention taken along lines 2—2 of FIG. 1.

As shown in FIG. 2, slicer apparatus 28 is mounted on a rotatable shaft 32 which extends between bearings 33 and 34 supported above driving knife 24 by frame supports 36 and 37. The slicer 28 is associated with a gear 38 on the end of shaft 32 outside bearing 34. Gear 38 engages gear 39 associated with the cutter apparatus 24 on shaft 46 to link slicer 28 to cutter 24. In this way, the knives operate simultaneously when cutting.

The cutter 24 includes a cage 40 which is defined by end plate 42, axially spaced end plate 43, and drum 44 having a plurality of radially oriented holes or slots 45 spaced equally apart around the drum periphery shown at 45 for illustration in FIG. 2. End plate 42 is connected to shaft 46 and is rotated by the shaft. The shaft 46 is supported in bearing 49 mounted on support 37. End plate 43 is mounted on rotating shaft 50 that is supported in bearing 48 mounted on support 36. The drum 44 is fixed between the end plates.

Drum 44 has a pair of radially extending arm members 52 attached at axially opposite ends of the drum. The driving knife blades 26 are securely mounted between the outermost ends of the arm members 52 and thus the knife blades 26 are mounted around the peripheral edge of cage 40 and rotate as cage 40 rotates.

A cone 60 is centered within cage 40 and is rotatably mounted therein. A screw 62 is threaded into a nut 64 fixed within cone 60 so that rotation of screw 62 causes cone 60 to move axially back and forth inside cage 40. The screw 62 is fixed to a shaft 66, within shaft 50, and is connected to an external handle 68. Rotation of handle 68 turns screw 62 and causes axial movement of the cone 60 within cage 40.

Figure 3:
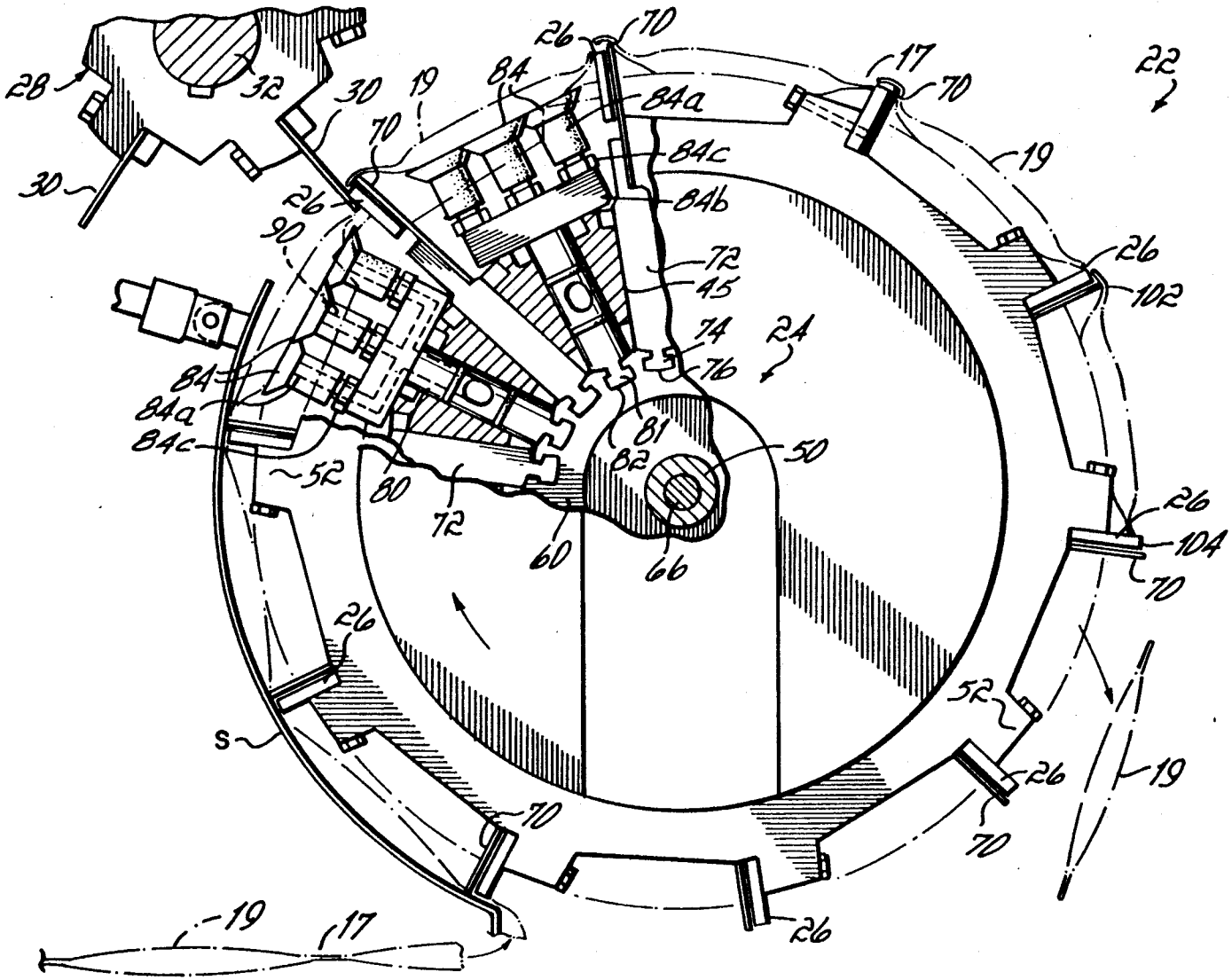
FIG. 3 is a cross-sectional view partially broken away and taken along lines 3—3 of FIG. 1.

A package guide 70 extends radially outwardly adjacent each knife blade 26. These guides contact the transverse seals 17 of pouch web 19 to align seal 17 with a cutting or shearing zone defined by the shearing cooperation of the respective cooperating knife blades 26, and 30 (FIG. 3).

Referring to FIG. 2, the package guide 70 has a planar body, extending between the pair of arm members 52, and which is radially slidable with respect to these arm members 52. Each package guide 70 is connected to cone 60 by a guide arm 72 having a T-shaped end 74. The T-shaped ends 74 of the guide arms 72 are axially slidable within a T-shaped slot 76 formed on cone 60. The T-shaped ends 74 and the corresponding T-shaped slots 76 in cone 60 slidingly interact so that the tapered cone surface slides across the ends of guide arms 72 slide as cone 60 moves axially. In this way, guide arm 72 follows the radial component of movement of inclined surface of cone 60 and the package guides 70 move radially inwardly or outwardly as handle 68 is turned to move cone 60 axially to the left or right, respectively.

The guide arms 72 extend from cone 60 to package guides 70 via holes or slots 45 extending radially through drum 44. As seen in FIG. 2, guide arms 72 and corresponding package guides 70 are in their most radially retracted position when cone 60 is in its leftmost position in cage 40 and guide arms 72 slide to the smallest diameter end of cone 60. Correspondingly, package guides 70 will be in their most radially extended position when cone 60 is moved to its farthest rightmost position inside cage 40 and the guide arms 72 slide toward the largest diameter end of the conical surface. The slots or holes 45 which house guide arms 72 allow radial movement of the package guides 70 while preventing axial movement. In this way, as the cone moves axially within the cage, the package guides only move radially inwardly or outwardly.

Adjacent to the drum 44 and on either side, there is a suction cup mount 80 radially extending from and slidably mounted to T-shaped slots in the cone. Like the guide arms 72, the suction cup mounts 80 have T-shaped bottoms 81 that slide within T-shaped slots 82 in the cone 60. The T-shaped slots 82 lie on either side of and alternate with the T-shaped slots 76 which hold the guide arms 72. As such, as seen in FIG. 3, the suction cup mounts 80 move radially inwardly and outwardly simultaneous with the package guides 70 as the cone 60 moves axially back and forth.

Each respective mount 80 carries a plurality of suction cups 84 which are used in gripping the individual filled pouches while the web of pouches 19 is cut. Three cups are shown; one, two or four cups or another number may be used. Four cups are useful for a variety of pouch sizes. During the cutting of the web into individual pouches, the suction cups 84 grip the pouches and hold the transverse seals 17 substantially perpendicular to the scissors action of the cooperating blades (FIG. 3).

Each cup 84 is mounted on a cup holder 84*a* which in turn is mounted on a carrier 84*b*, all of which are best seen in FIG. 3 (FIG. 2 shows the cup holders only in more diagrammatic form). The holders are separately adjustable independently of the carrier 84*b*, knives 26 and package guides 70. This permits separate and independent adjustment of the cups for fine-tuning their holding function.

The suction cup grip action on the pouches is accomplished by vacuum lines running to each individual suction cup 84. While the suction cups and the vacuum system will be described in brief, its details are clearly available from U.S. Pat. No. 4,872,382, incorporated herein by reference. Drum 44 has a plurality of axial passageways 86 communicating with a radial passageway 88 in suction cup mounts 80 (FIG. 2). Each radial passageway 88 in each mount 80 is then linked to the individual suction cups 84 by forked line or passage 90 which has branches running to each suction cup. Each axial passageway 86, in turn, is connected to a respective port 92 in rotating plate 94 which is bolted to plate 43. That plate 94 rotates with respect to a fixed vacuum manifold 96 that carries a shoe 98 which rides on the rotating plate 94. The shoe 98 carries a plurality of staggered arcuate slots 100 which communicate with manifold 96. When a port 92 overlies arcuate slot 100, passage 86 connects vacuum manifold 96 to respective suction cups 84. The vacuum connection is made at approximately the time the cut is made through seal 17 of each pouch so the pouch is held firmly across the blades, and the vacuum is maintained (that is arcuate slot 100 is extended) until port 92 moves past the next to last slot 100, at which point the vacuum to the cups 84 ceases. This holds the pouches in position until they are to be dropped onto a conveyor, for example (FIGS. 1 and 3).

The arcuate slots 100 are staggered so that if a pouch drops off a particular set of cups 84 and causes those cups to lose vacuum, that set of cups 84 remains isolated from adjacent sets. The last slot does not communicate with vacuum manifold 96; instead, it is connected by a port to a source of air under pressure. When the slot reaches the port, a puff of air pushes the individual pouch onto a conveyor. (See pouch 19, FIG. 3)

Accordingly, it will be appreciated that the slots 100 and ports 92 are configured to provide vacuum to each respective set of cuts 94 during a predetermined arcuate segment of cup movement and in time with a desired portion of the pouch cutting operation.

It will also be appreciated that a curved shroud S (FIG. 3) is disposed about cutter 24 through an arcuate segment for guiding and holding pouches against the guides 70 as they approach the shearing position.

Figure 4:
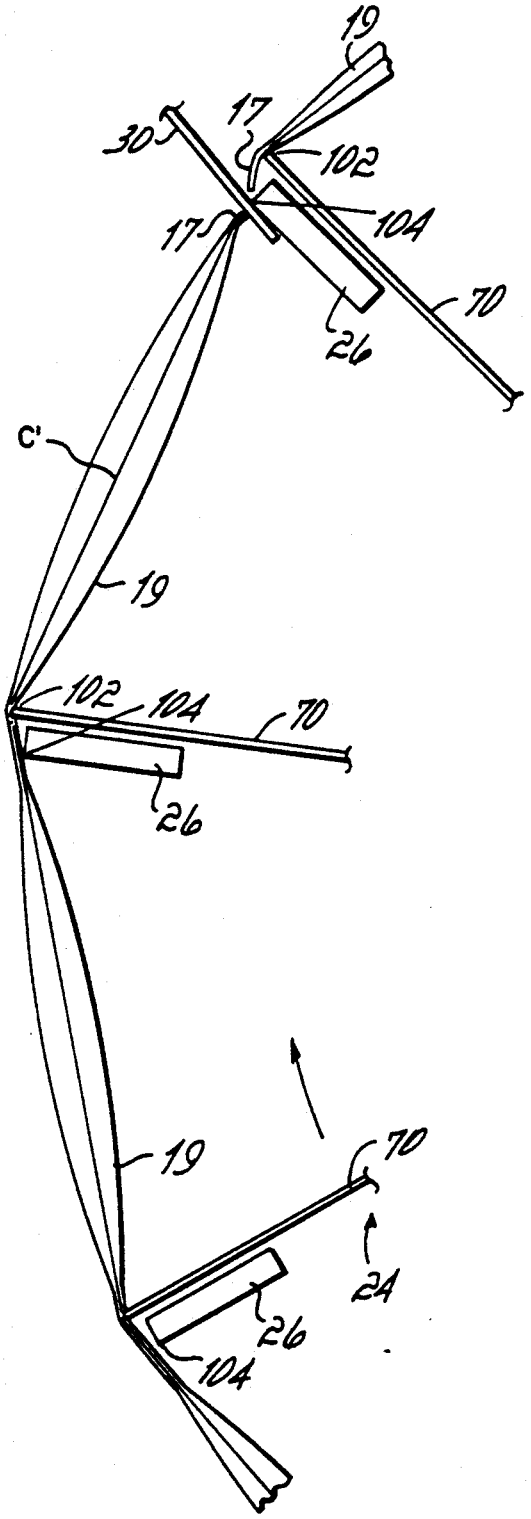
FIG. 4 is an enlarged diagrammatic view of the invention showing the package guides in extended position.
Figure 5:
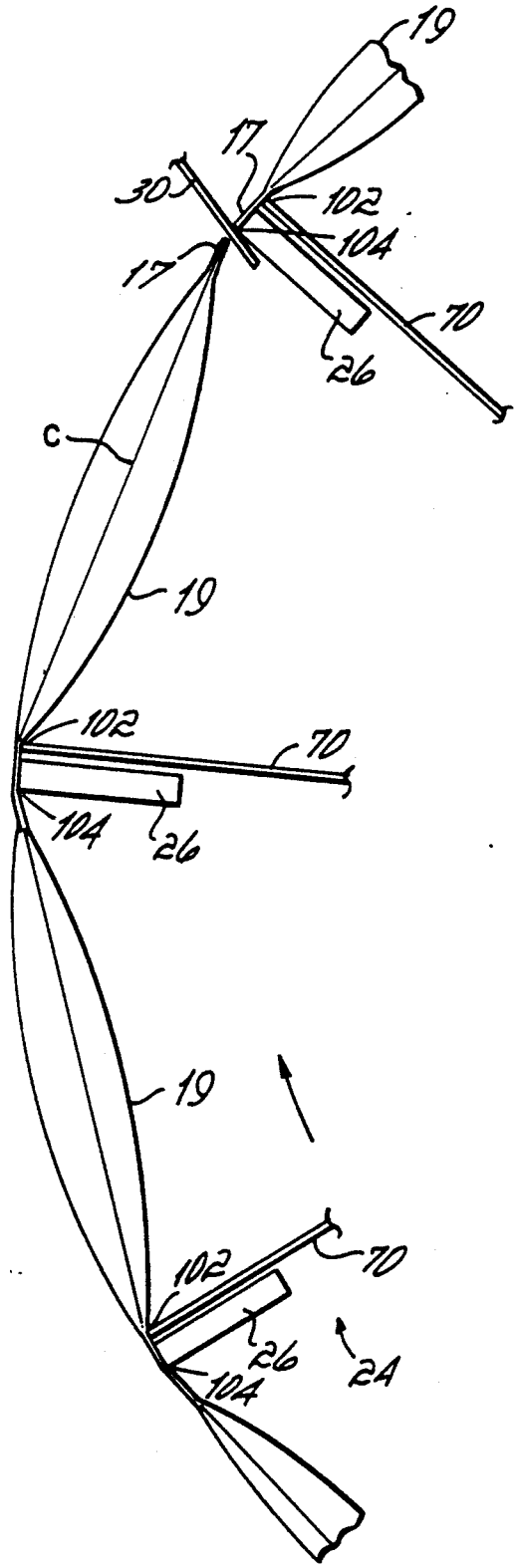
FIG. 5 is an enlarged diagrammatic view of the invention showing the package guides in retracted position.

When the web of filled, sealed pouches 19 is stretched around the circular cutting cage 40, and supported by package guides 70, the center distance between adjacent transverse seals on the pouches is defined as the pouch chord. Referring to FIGS. 4 and 5, it is seen that when a pouch is substantially filled (FIG. 5), the pouch chord C will be shorter than the pouch chord C′ when the pouch is not so substantially filled (FIG. 4).

In operation the pouch chord changes for different fills of pouches. In the past, the cutting positions of the knives were adjusted radially with respect to the transverse seals 17, or each packaging guide was separately and individually adjusted, in an attempt to accommodate this chord change. In the present invention, these chord changes are accommodated by changing the radial position of the package guides 70, simultaneously and independently of knife blades 26, while leaving the knife blades 26 in fixed position. This accommodates greater pouch chord changes than the prior knife for adjustment techniques.

In one embodiment, for the most fully filled pouches (FIG. 5), the radially outward edges 102 of the package guides 70 are adjusted so as to be flush with the radially outward edges 104 of blades 26 (FIG. 5). Alternatively, movement of cone 60 axially toward handle 68 would push the ends 102 of package guides 70 radially outward to extend beyond the blade edges 104 (FIG. 4). Such a position corresponds to a lightly filled package which has a greater transverse body length and therefore requires a greater chord distance (C′) on the cutter apparatus cage to properly align the cutting blades with the transverse seals.

Moreover, in the prior art, when the driving knife blades 26 are moved radially outwardly or inwardly, to accommodate changing pouch chords, slicer blades 30 have to be adjusted accordingly so that the two blades properly interact to produce a proper shearing action across seal 17. In the present invention, because the blades 26 of cutter 24 remain fixed to cage 40, regardless of the fill size of the package being cut, there is no need to adjust the blades of driven knife 28. Furthermore, by keeping blades 26 stationary, and only adjusting the package guides 70, the cutter apparatus 22 is able to accommodate a much wider range of pouch sizes or fills (i.e. changes in package chord lengths) than if the blades of the driving knife 24 were adjusted throughout the same radial adjustment distance.

Finally, it will be appreciated that where a plurality of pouch pre-filled design sizes are to be handled on the same form, fill and seal apparatus, the known prior art would have required a relatively large number of change-over knife assemblies. According to the invention, which accommodates wider ranges of pouch chord variations, a fewer number of change-over knife assemblies can accommodate a larger range of pouch chord variations and pre-fill design sizes.

From the above disclosure of the general principles of the present invention and the preceding detailed description of a preferred embodiment, those skilled in the art will readily comprehend the various modifications to which the present invention is susceptible without departing from the scope of the present invention. Therefore, we desire to be limited only by the scope of the following claims and equivalents thereof.

We claim:

1. An adjustable cutter apparatus for a web of filled pouches, the apparatus comprising:

a rotatable cage having an axis of rotation, a plurality of knife blades mounted on, and radially extending from said cage for cooperating with a second plurality of rotating knife blades to cut individual pouches from a web of filled pouches moving about said cage, a screw mounted within said cage on said axis of rotation, a cone disposed within said cage and mounted on said screw for axial movement upon rotation of said screw, said cone having a conical surface, a plurality of axially-extending grooves spaced about the conical surface of said cone, a plurality of radially extending pouch guides, each of said guides mounted independently of said knife blades and being slidably interconnected with one of said respective grooves to move said guides radially in and out, independently of said knife blades as the cone moves back and forth, means on said cage for supporting each said guide in a radial position and blocking axial movement while permitting radial movement, whereby rotation of said screw causes said cone to move axially with respect to said cage, the axial movement of said cone causing radial movement of said pouch guides independently of said knife blades to accommodate different pouch chords due to at least one of different pouch sizes and different product fills.

2. Apparatus as in claim 1 wherein said supporting means on said cage includes a drum having a plurality of radially extending passages therethrough, and wherein said pouch guides are mounted on respective guide arms, said guide arms respectively extending through respective ones of said passages and having radially inward ends operably interconnected respectively with the grooves in said conical surface.

3. An adjustable cutter apparatus for a web of filled pouches, the apparatus comprising:

a first rotary knife means including a plurality of radially extending knife blades, a second rotary knife means including at least one radially extending knife blade for cooperating with said first knife means for cutting individual filled pouches from said web, a plurality of radially extending pouch guides cooperating with said first rotary knife means, said pouch guides being selectively extensible and retractable in respective radial directions, simultaneously and independently of said radially extending knife blades of said first rotary knife means to accommodate pouches of varying chords.

4. Cutter apparatus as in claim 3 wherein one of said pouch guides is disposed adjacent each radially extending knife blade of said first knife means, each of said guides having a pouch engaging surface disposed for movement between two positions, and wherein one of said positions is extended radially outwardly to at least the same plane as a forward edge of an adjacent knife blade and the other of said positions is extended further radially outward of a forward edge of an adjacent knife blade.

5. In a cutter apparatus for a web of filled pouches, said apparatus of the type comprising first and second rotary knife means, at least one such knife means having a plurality of radially extending knife blades and a plurality of pouch guides operatively associated with said plurality of knife blades on said one rotary knife means, the improvement comprising:

means for adjusting said pouch guides in a radial direction simultaneously and independently of the radial extension of said associated knife blades for accommodating a plurality of pouch chords.

6. Cutter apparatus as in claim 5 wherein said pouch guides are extensible to a position radially outwardly of the outer extension of said knife blades and are retractable to a position at least radially equal to the outer extension of said knife blades.

7. Apparatus as in claim 5 further including a plurality of suction cups, at least one suction cup mounted between each radially extending knife blade for holding a pouch therebetween and further including means for adjusting the radial position of said suction cups simultaneously with and in response to adjustment of said pouch guides in a radial direction.

8. Apparatus as in claim 7 further including means for adjusting the radial position of said suction cups independently of said pouch guides.

9. A method of cutting pouches from a continuous web of a train of pouches having transverse seals between each pouch, said method comprising the steps of:

running said web between two rotary cutter means, one of said rotary cutter means including a plurality of radially extending knife blades and pouch guides adjacent said blades, cutting through said transverse seals at a shearing station between said cutter means, and radially adjusting said pouch guides simultaneously and independently of said knives to accommodate pouches having different pouch chords.

* * * * *